United States Patent [19]

Plöckinger et al.

[11] 4,265,295

[45] May 5, 1981

[54] METHOD OF PRODUCING STEEL INGOTS

[75] Inventors: Erwin Plöckinger; Gert Kühnelt, both of Kapfenberg; Peter Machner, Leoben; Heimo Jäger, Bruck a.d. Mur, all of Austria

[73] Assignee: Vereinigte Edelstahlwerke Aktiengesellschaft (VEW), Vienna, Austria

[21] Appl. No.: 743,102

[22] Filed: Nov. 19, 1976

[30] Foreign Application Priority Data

Nov. 17, 1975 [AT] Austria ..... 8719/75

[51] Int. Cl.[3] ..... B22D 27/02; B22D 27/06

[52] U.S. Cl. ..... 164/52; 164/57

[58] Field of Search ..... 164/52, 50, 57, 122, 164/352

[56] References Cited

U.S. PATENT DOCUMENTS

| | | | |
|---|---|---|---|
| 2,230,296 | 2/1941 | Hopkins | 164/52 |
| 2,248,628 | 7/1941 | Hopkins | 164/52 |
| 3,786,853 | 1/1974 | Cooper | 164/52 |
| 3,820,587 | 6/1974 | Plockinger et al. | 164/252 |
| 3,916,978 | 11/1975 | Plockinger et al. | 164/52 |
| 4,036,278 | 7/1977 | Ramacciotti | 164/52 |

FOREIGN PATENT DOCUMENTS

| | | | |
|---|---|---|---|
| 107405 | 5/1939 | Australia | 164/52 |
| 835406 | 3/1976 | Belgium . | |
| 2522754 | 12/1975 | Fed. Rep. of Germany . | |
| 2550642 | 5/1976 | Fed. Rep. of Germany . | |
| 2452277 | 8/1976 | Fed. Rep. of Germany . | |
| 2360883 | 10/1976 | Fed. Rep. of Germany . | |

*Primary Examiner*—Robert D. Baldwin

[57] ABSTRACT

In a method of producing ingots of unalloyed and alloyed steels having an improved primary crystallization, reduced ingot segregation and a reduced content of non-metallic inclusions, liquid steel is poured into a mould in an amount substantially approximately equal to the desired weight of the ingot to be obtained, slag is applied to the steel and energy is supplied to the already melted slag to maintain the liquid core zone of the slag at a high temperature, while the walls laterally confining the slag are cooled to create and maintain a layer of solid slag in that area, the energy supply to the slag is effected by resistance heating by means of at least one consumable electrode having a chemical composition identical or similar to that of the ingot, and the quantitative composition of the at least one consumable electrode is selected in a manner as to obtain a concentration of segregating elements in the amount of steel melted off per time unit that is lower by that amount in which the concentration of segregating elements increases per time unit in the remaining melt of the ingot.

2 Claims, 1 Drawing Figure

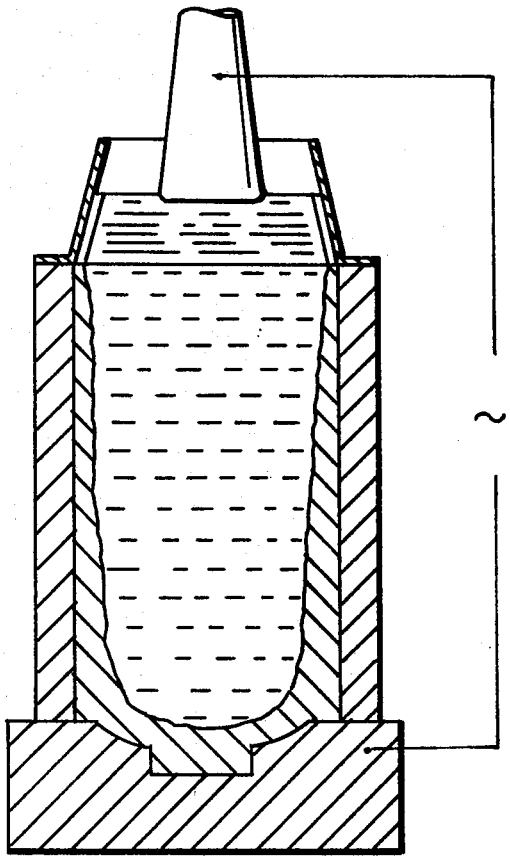

METHOD OF PRODUCING STEEL INGOTS

BACKGROUND OF THE INVENTION

The invention relates to a method of producing ingots of unalloyed and alloyed steels having an improved primary crystallization, reduced ingot segregation and a reduced content of non-metallic inclusions, wherein molten steel in an amount at least approximately corresponding to the desired weight of the ingot is poured into the mould, whereupon slag is supplied on it and this slag in turn is supplied with energy during the solidification of the steel, wherein, with a substantially constant ingot height, by supplying energy to the already molten slag corresponding to at least 120 kilowatt-hours or at least 103,200 Kcal/metric ton of ingot weight, the liquid core zone of that slag is kept at a high temperature while for forming and maintaining a layer of solid slag at the walls laterally confining the slag, cooling thereof is effected by means of a liquid. If desired, a melt electrolysis can be simultaneously effected in the liquid slag by the additional use of a direct current. (A method of this kind is described e.g. in Austrian Pat. No. 282,845 and British Pat. No. 1,254,546, respectively).

The supply of energy to the slag, according to such a method can be effected by resistance heating with the help of an alternating current by means of one or more consumable electrodes which have the same or a similar composition as the ingot. When using consumable electrodes having the same chemical composition as the molten steel solidifying in the mould, segregations over the longitudinal extension of the ingot and difficulties can occur, if the interval of solidification of the alloy is very wide and when in the course of crystallization a ledeburitic eutectic is formed. Segregation phenomena lead to a continuous change of the average composition of the material, in that during the crystallization process the segregating elements, such as C, Cr, W, V, Mo, Mn and S show a higher concentration from the bottom towards the top in the volumes of the ingot solidifying one behind the other. In very large forging ingots of unalloyed and alloyed structural steels (having a weight of over about 20 metric tons, e.g.), or in substantially smaller ingots of ledeburitic steels (having a weight starting from about 1.5 metric tons), the differences in the chemical composition over the cross-section of the ingot can be so great that they noticeably affect the technological properties.

The invention aims at preventing the above described difficulties and aims at an improvement or advantageous adaptation of the above described method in that sense that also in very large forging ingots or steels with strong segregation at crystallization, segregation-free crude ingots having a substantially constant chemical composition over their longitudinal extension are obtained.

The characterising feature of the method according to the present invention consists in that the quantitative composition of the consumable electrode(s) used is selected in such a manner that the concentration of the segregating elements in the amount of steel melted-off per time unit is lower by the amount by which its concentration per time unit increases in the remaining melt of the ingot.

In order to obtain the correct selection of the quantitative chemical composition of the consumable electrode(s), the concentration of the segregating elements in the solidifying ingot is determined from time to time during preliminary tests taken. In most cases it suffices when the calculation of the alloy content of the consumable electrode(s) is based on a mean value of the enrichment of the alloying elements in the remaining melt over a certain period of time, such as an hour, e.g.

According to a preferred embodiment, the chemical composition of the remaining melt is kept constant by an optimal adjustment of the melting-off rate, in that the supply of energy to the consumable electrode necessary for fusing it down is controlled, i.e. gradually reduced.

When producing large forging ingots having long periods of solidification and an enrichment of accompanying and alloying elements in the remaining melt of the ingot that strongly increases towards the end of solidification, it may be necessary to use two or more consumable electrodes in temporal sequence, the chemical composition of which is adapted to the enrichment of the segregating elements to be expected.

It is possible to use a number of consumable electrodes instead of one consumable electrode, e.g. when the ingots have wide diameters, which consumable electrodes have the same chemical compositions, or whose chemical compositions, if they differ among themselves, give a mean value when the alloy is equalized which corresponds to the composition required.

For equalizing comparatively low ingot segregations it is advantageous to use one single conically designed electrode instead of a number of consumable electrodes of varying compositions which are successively melted off, from which single electrode, at the beginning of the process larger amounts of steel are melted off per time unit from the electrode end having the wider diameter by using currents of a correspondingly high intensity, whereas, while the ingot continues to solidify, due to the decreasing diameter of the electrode and a reduction in power supplied, the respective required smaller amounts of steel are supplied to the solidifying ingot.

BRIEF DESCRIPTION OF DRAWING

The single FIGURE of the drawing illustrates schematically in elevation a conically shaped electrode used in the method of the invention.

DETAILED DESCRIPTION

The method according to the invention shall now be described in more detail by way of the following examples:

EXAMPLE 1

A segregation-free 30-metric-ton forging ingot of an unalloyed steel (CK35) having a substantially constant chemical composition was produced by using two consumable electrodes of 1000 kg each in the following manner:

A melt of 29.8 metric tons of the unalloyed steel CK35 having 0.34% C, 0.25% Si, 0.38% Mn, 0.015% P and 0.012% S was poured into a polygonal mould having a mean diameter of 1525 mm and a height of 2100 mm, which mould was provided with a water-cooled head (as in Austrian Pat. No. 295,764). The melt was immediately covered with liquid slag, and the slag was heated in accordance with Austrian Pat. No. 282,845 and British Pat. No. 1,254,546, respectively. During the first 100 minutes heating was effected by melting off one electrode having a diameter of 300 mm with 14 KA. This electrode consisted of an unalloyed steel having 0.04% C and about the same contents of Si, Mn, P and S as the CK35-melt in the mould. Thus for this electrode a carbon content of 0.04% was chosen in order to counterbalance the segregation of the carbon to be expected during the solidification of the ingot. After 100 minutes, 18.2 metric tons=about 60% of the melt had solidified in the mould. A sample taken from the solidified part of the ingot showed a carbon content of 0.345%. Thus the carbon enrichment in the remaining melt, which otherwise occurs, was counterbalanced by the fusing down of the low-carbon electrode.

Until the complete solidification of the 30 metric-ton ingot, which altogether took 900 minutes, the heating of the ingot top was continued using a second electrode of equal dimensions and equal weight, wherein the carbon content of this electrode was selected to amount to 0.30%, while the remaining chemical composition was analogous. In order to adapt the consumption rate of the electrode and the heat supply necessary to the respective volume of the remaining molten steel in the mould, the energy supply was gradually reduced from 8 KA to 4.2 KA; until the end of solidification, 1000 kg steel were melted off the electrode.

From this 30 metric-ton ingot, which later on was shaped to forged shafts, samples were taken for determining the C-content from the areas of the bottom of the ingot, the middle of the ingot and the top of the ingot. The C-contents found in the sample discs taken from various spots of the cross-section, were between 0.32 and 0.33% in the bottom of the ingot, between 0.33 and 0.34% in the middle of the ingot, and between 0.33 and 0.345% in the top of the ingot. On the other hand, the carbon content in conventionally solidified 30 metric-ton ingots of CK35 having 0.34% C in the starting melt, due to segregation occuring during solidification is between about 0.36 and 0.37% in the middle of the ingot, and in the top of the ingot in the areas of segregation it is up to 0.43%.

EXAMPLE 2

A segregation-free 22 metric-ton ingot of a DCMV58 steel (0.20/0.25% C) was produced, having a substantially constant chemical composition, by using a conical consumable electrode having a lower diameter of 450 mm and an upper cross-section of 350 mm diameter and a weight of 1550 kg, in the following manner:

22 metric tons of the melt having a carbon content of 0.25% were poured into a mould having a mean diameter of 1440 mm and a height of 1980 mm and covered with molten slag. Heating of the slag was effected during the first hours with 12 KA by using an electrode of unalloyed steel having a C-content of 0.18%. After 60 minutes 12 metric tons=55% of the melt had solidified; the C-content of the solidified ingot amounted to 0.24%. In the second, third and fourth hour, heating was continued with the same electrode with 7.5 KA, and further 6.2 metric tons solidified; the C-content amounted to 0.25%. During the fifth to seventh hour, heating was continued with 6 KA. Further 2.35 metric tons solidified; the C-content amounted to 0.25%. In the eighth to the thirteenth hour, heating was continued with 4.5 KA. The remaining amount of steel solidified, i.e. 2.7 metric tons; the C-content was 0.25%.

EXAMPLE 3

A segregation-free 2 metric-ton ingot of a rapid machining steel ingot SRE of a substantially constant chemical composition was produced by using an electrode having a diameter of 150 mm, a length of 1500 mm and a weight of 230 kg.

2 Metric tons of the melt having a composition of 0.78% C, 18.2% W and 1.15% V were poured into a mould having a mean diameter of 600 mm and a height of 900 mm, and the melt was immediately covered with molten slag. Heating was effected during the first 15 minutes with 2.5 KA by using an electrode consisting of a steel having 0.72% C, 17.5% W and 1.0% V. After 15 minutes, 1.02 metric tons=51% had solidified, and 30 kg had melted off the electrode. The C-content amounted to 0.76%, the W-content to 18.12% and the V-content to 1.12%.

Heating with the consumable electrode was continued for further 60 minutes with 2.5 KA, and 0.62 metric tons solidified and 90 kg were melted off the electrode. The C-content amounted to 0.78%, the W-content to 18.18% and the V-content to 1.15%.

Melting-off was continued for 150 minutes with 1.5 KA. 0.31 metric tons solidified, with 0.78% C, 18.14% W and 1.15% V. During the further 225 minutes until the entire solidification of the ingot, 230 kg solidified, also having 0.78% C, 18.11% W and 1.13% V.

Although the invention is illustrated and described to one preferred embodiment thereof, it is to be expressly understood that it is in no way limited to the disclosure of such a preferred embodiment, but is capable of numerous modifications within the scope of the appended claims.

What we claim is:

1. An improved method of producing ingots of unalloyed and alloyed steels having an improved primary crystallization reduced ingot segregation and a reduced content of non-metallic inclusions,, comprising the steps of pouring liquid steel into a mold in an amount corresponding at least approximately to that of the preselected weight of the ingot to be produced, then dosing said mold containing the liquid steel with melted slag, confining said melted slag laterally by means of liquid-cooled walls so that a layer of solid slag is formed and maintained adjacent said walls, supplying energy by electric resistance heating by means of at least one consumable electrode to said melted slag during solidification of said liquid steel which forms a partially solidified ingot having a remaining melt, the chemical composition of said consumable electrode being substantially equal to that of the formed steel ingot, the supply of electric energy to the liquid core zone of the already melted slag being at least 120 kilowatt-hours per metric ton of ingot weight so that said liquid core zone of the slag is maintained at a high temperature, the improvement comprising the steps of determining the concentration increase per unit of time of segregation elements in the remaining melt of the ingot and selecting a quantitive composition for the at least one consumable electrode which will supply a concentration of segregation elements in the amount of steel melted off per unit of time lower by the amount corresponding to said increase, said at least one consumable electrode being conical in shape thus having a smaller diameter at one end and a wider diameter at the other end, and melting-off is started at the end of the electrode having the wider diameter.

2. A method as set forth in claim 1, wherein energy is supplied to the at least one consumable electrode in gradually lessening degrees to regulate the amount of steel necessary to be melted off the at least one consumable electrode in order to obtain a uniform concentration.

* * * * *